United States Patent [19]

Stahlecker et al.

[11] 4,389,837

[45] Jun. 28, 1983

[54] PLY YARN SPINNING ASSEMBLY

[75] Inventors: Hans Stahlecker, Haldenstrasse 20, 7334 Suessen, Fed. Rep. of Germany; Hans Braxmeier, Suessen, Fed. Rep. of Germany

[73] Assignees: Fritz Stahlecker; Hans Stahlecker, of DEX

[21] Appl. No.: 272,261

[22] Filed: Jun. 10, 1981

[30] Foreign Application Priority Data

Jun. 13, 1980 [DE] Fed. Rep. of Germany ..... 3022149

[51] Int. Cl.[3] ..... D01H 13/22; D01H 13/16

[52] U.S. Cl. ..... 57/16; 57/18; 57/19; 57/78; 57/80; 57/264

[58] Field of Search ..... 57/3, 6, 16, 17–19, 57/78, 79, 80, 81, 82, 83, 84, 88, 89, 261, 264; 19/267, 0.25

[56] References Cited

U.S. PATENT DOCUMENTS

| | | | |
|---|---|---|---|
| 1,885,423 | 11/1932 | Fenton | 57/84 |
| 2,023,407 | 12/1935 | Cobb | 57/19 |
| 3,124,843 | 3/1964 | Adams et al. | 19/0.25 |
| 3,609,820 | 10/1971 | Hohloch | 19/267 |
| 4,117,654 | 10/1978 | Petrov et al. | 57/80 |
| 4,228,639 | 10/1980 | Hunt et al. | 57/16 |

*Primary Examiner*—Donald Watkins
*Attorney, Agent, or Firm*—Craig & Burns

[57] ABSTRACT

The invention involves a ply or wrapped yarn spinning assembly of the type having a drawing unit supplying a sliver through one or more hollow spindles, at which hollow spindles a binding thread is wrapped spirally around the sliver to form yarn. Yarn condition monitors detect the yarn condition and the supply of binding thread. In the event of a malfunction, including exhaustion of binding thread at a hollow spindle, the monitors automatically disengage the supply of sliver by pivoting open a load bearing member of the drawing unit. In preferred embodiments the monitors also actuate mechanical actuators for pivoting driving or driven rollers of the hollow spindles, yarn take-off rolls, and a yarn windup device of the spinning assembly. An auxiliary thread bobbin and associated cutter mechanisms are also provided to facilitate restarting after a malfunction and shutdown.

29 Claims, 4 Drawing Figures

PLY YARN SPINNING ASSEMBLY

BACKGROUND AND SUMMARY OF THE INVENTION

The invention relates to improvements in a ply or wrapped yarn spinning assembly with a drawing mechanism for drawing sliver, at least one hollow spindle arranged downstream of the drawing mechanism with a bobbin with binding thread placed thereon for binding the sliver to form ply yarn, a pair of take-off rolls for the ply yarn, and a windup (take-up) device for the ply yarn, as well as drive means for these component parts and a thread monitoring device which upon a disturbance in the spinning operation automatically interrupts the drive mechanisms for the component parts arranged downstream of the drawing unit.

Ply yarn spinning assemblies of this general type have been contemplated, such as shown in German Unexamined Laid Open Application (DOS) No. 2,753,349. In the previously contemplated types of construction, the provision is made to automatically arrest the impaired spinning station in case of thread break while all other spinning stations of the machine continue operation. For this purpose, the bundle of spinning fiber exiting from the drawing unit is seized by a suction tube and deflected from its travel direction. At the same time, a thread monitor is swung away due to the fading thread tension and closes contact with a switch interrupting several drive mechanisms.

Thus, on the one hand, the drive of the hollow spindle is interrupted by the feature that a solenoid-operated device lifts the driving tangential belt off the spindle and applies a brake. Furthermore, the pressure roll of a pair of take-off rolls is lifted off the drive roll, likewise by way of solenoid operation. Finally, a plunger is provided which lifts the windup bobbin off its drive roll, likewise under the action of a solenoid. Operation is resumed in such types of construction by pneumatic means, especially by the connection and disconnection of suction streams which combine the individual thread components and rethread same into the spinning unit.

A disadvantage of the above noted previously contemplated types of construction resides in that the shutoff operation due to thread break functions only if the breaking site lies between the exit from the drawing unit and the entrance into the hollow spindle. Only in this case is it possible to remove by suction the sliver which is still being fed from the drawing unit. If the thread break occurs at some other location, for example downstream of the hollow spindle, then the sliver feed into the hollow spindle is continued. With the spindle speeds nowadays customary, about 30,000 per minute, and production rates of about 200 meters/minute, this can result in grave damage to the spinning assembly. Even if the sliver supplied by the drawing unit is properly removed by suction, a relatively high loss of material occurs for the aforementioned reasons, because the sliver is removed by suction until the disturbance at the respective spinning station has been eliminated. Another disadvantage is that the solenoids (electromagnets) provided in the conventional machine for operating the shutoff process represent units which are operable independently of one another and which are relatively expensive and can show impairment of their function individually, which then leads to a disturbance of the entire procedure. Also the operating safety of such electrically operated drive elements requires constant servicing thereof.

Therefore, it is an object of the present invention to construct a ply yarn spinning machine in such a way that, in case of disturbance, the individual shutoff of the impaired spinning assembly becomes possible in a very simple way, without the occurrence of subsequent damage and loss of production in case of such a disturbance. Also, a possibility is to be provided in especially preferred embodiments for operating all individual assemblies safely and in dependence upon one another during the shutdown step—and also during the subsequent restarting step.

This above noted object has been attained by associating with the drawing unit a mechanical operating means for swinging open the load-bearing means, which operating means is triggered in case of a breakdown by the thread monitoring device. This arrangement has the advantage that, in case of a mishap, not only is the drive of the subsequently disposed component parts interrupted but also the assembly feeding the sliver is arrested so that loss of spinning material can be avoided. Also, ensuing damage by additionally fed fiber material is thus avoided with certainty. The arrangement of this invention also has the advantage that a very simple mechanical operation becomes possible which advantageously can furthermore be designed in such a way that also for interrupting the drive mechanisms of the other subunits it is possible to provide a corresponding, or even the same, mechanical operating means. It is especially advantageous for this purpose to equip all subunits with drivable parts which can be swung away from constantly revolving, driven parts, so that then the mechanical operating means can consist, for example, of an operating rod actuatable by way of pressure cylinders according to especially preferred embodiments. This arrangement, besides exhibiting a simple mechanical structure likewise ensuring a safe and readily controllable functioning, also has the advantage that the precondition is provided for being able to start up the spinning station in synchronism after elimination of the breakdown.

An especially simple, but effective, preferred design is obtained by associating the operating rod guide means for interrupting the drive mechanisms of the hollow spindles, of the pair of take-off rolls, and of the windup device. Such guide means are preferably fashioned as guide pins in an especially simple way, which guide pins control respectively one lever arm fashioned as a leaf spring and respectively attached to the component of the individual assemblies which can be pivoted away from the drive means. This construction has the advantage that the leaf springs can be slidingly guided between guide pins in an especially easy fashion, but that, on the other hand, these leaf springs can also provide the required pretensioning to be able to urge the respective unit against the drive means in the operating condition.

In an advantageous preferred embodiment, two series-arranged hollow spindles are provided which are configured to be swung away from the respective drive belt with their drive whorls. The series connection of two hollow spindles makes it possible to increase production. The swinging away of the hollow spindles offers the advantage, besides the interruption of the drive, that the bobbins enter into a position favorable for controlling the binding thread during changing of the feed bobbin.

In a further development of preferred embodiments, the provision is made that the windup device comprises a drive roll and, at a radial spacing therefrom, a grooved roll, both of which are in engagement with a drive-transmitting friction pressure roll, which latter is configured to be swung away from the grooved roll. It is thereby possible to interrupt the drive for the windup device without having to lift the windup roll proper off the grooved roll. For a lifting off of the windup roll is problematic inasmuch as, on the one hand, the bobbin arm must traverse differing distances—due to the varying bobbin diameters possible—and, on the other hand, the measure provided in conventional spinning assemblies has the effect of squeezing the thread laps of the windup bobbin, which is not the case here due to the novel construction.

To fashion the monitoring process especially effective, the provision is made in preferred embodiments, that respectively one thread monitor is arranged between the drawing unit and the hollow spindle, as well as between the hollow spindle and the pair of take-off rolls. In this way, the monitoring step not only covers the thus-produced entire thread—which due to a reduction in tension already responds if only one component is broken—but additionally covers the sliver exiting from the drawing unit.

In a further embodiment of the invention, each hollow spindle is associated with a preferably optical device for scanning the degreee of fullness of the bobbin for the binding thread. It is important to monitor the degree of fullness of the binding thread bobbin, because trouble also occurs, after all, if the binding thread bobbin no longer supplies any thread. The optical monitoring of the binding thread bobbin suitably utilizes the differing reflective characteristic at the hollow spindle since—depending on whether or not the feed bobbin still contains a thread—a light beam emanating from the thread monitor will be differently reflected.

To restart the spinning assembly, a bobbin with an auxiliary thread is provided in accordance with especially preferred embodiments of the invention. Thereby the piecing operation is substantially facilitated. If no auxiliary thread were used, there would be the danger that the still untwisted sliver during startup is immediately broken again at the critical point upon entrance into the hollow spindle. The auxiliary thread naturally exhibits an increased strength and serves temporarily as a guide means for the remaining components. The pneumatic units for piecing purposes as they are arranged in previously contemplated types of construction can be omitted.

It is advantageous to feed the auxiliary thread to a suction removal device arranged in the zone of the windup means but in such a way that the auxiliary thread does not pass on to the windup bobbin. It is ensured in this way that neither the auxiliary thread nor the piece of yarn, which deviates in quality during the piecing operation from the quality obtained during normal operation, can enter the normal bobbin.

It is advantageous to associate with the auxiliary thread, after the bobbin as well as in front of the suction removal means, a cutting device according to preferred embodiments. It is possible in this way to remove the auxiliary thread again after the piecing operation has been completed, whereupon the normal ply yarn can be fed again to the windup bobbin.

In an advantageous embodiment of the invention, the drawing unit, the spindles, the pair of take-off rolls, and the windup device are arranged to be started up simultaneously. With the use of an automatic piecer, it is possible by this measure to do without an auxiliary piecing thread. Since the take-off rolls and the windup device attain full speed more rapidly than the spindles, it is advantageous herein to provide that the whorls of the spindles come into engagement with the drive belt somewhat earlier than the remaining elements to be driven.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Only those parts of the spinning assemblies are shown and described which are deemed necessary for one skilled in the art to understand the invention.

Figure 1:
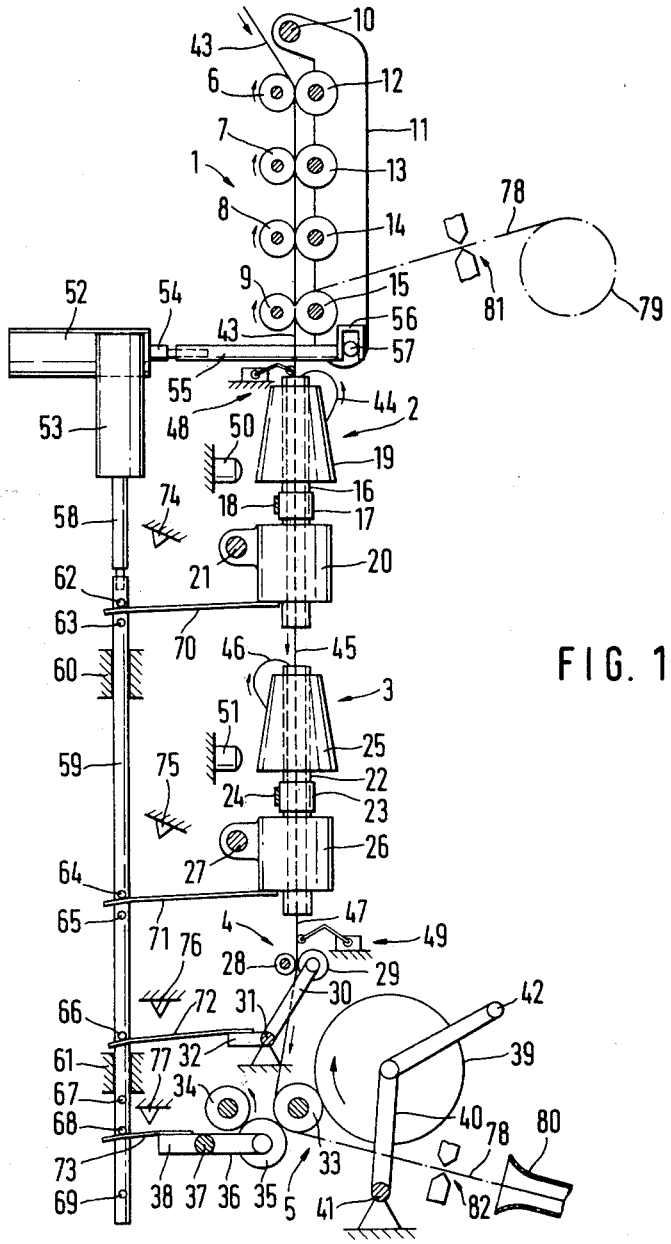
FIG. 1 is a schematic view which shows a ply yarn spinning assembly constructed according to a preferred embodiment of the invention and in a spinning operating position.

FIG. 1 shows the ply yarn spinning assembly in an operating spinning condition, wherein the auxiliary thread 78 drawn in dot-dash lines should be ignored at this point of the description.

The spinning assembly comprises, inter alia, a drawing unit 1, two hollow spindles 2 and 3, a pair of takeoff rolls 4, as well as a windup device 5. The drawing unit 1 contains four bottom rolls 6, 7, 8, and 9 which are driven and pass through the machine, wherein the number of these rolls can vary in dependence on the particular usage. These bottom rolls 6, 7, 8, and 9 are associated with top rolls 12, 13, 14, and 15 extending preferably only over one spinning station and being arranged in a load-bearing member 11 pivotable about an axle 10 affixed to the machine. The pressure rolls 12, 13, 14, and 15 are urged preferably under spring pressure against the driven bottom rolls 6, 7, 8, and 9. In this connection, the provision is made that the respectively subsequent pair of rolls runs faster than the preceding pair of rolls of the drawing unit 1. For example, the pair of rolls 7, 13 runs faster than the pair of rolls 6, 12, whereas the pair of rolls 8, 14, in turn, runs faster than the pair of rolls 7, 13, so that the sliver 43 fed in the direction of the arrow to the first roll pair 6 and 12 is stretched from one pair of rolls to the next pair of rolls.

The drawing unit 1 is followed by two hollow spindles 2 and 3. These hollow spindles 2 and 3, respectively, consist of a rotating spindle part 16 and 22, respectively, driven via respectively one drive whorl 17 and 23 by tangential belts 18 and 24.

A concomitantly rotating binding thread bobbin 19 and 25 is nonrotationally attached to the spindles 2 and 3, respectively. The spindle part 16 or 22 is rotatably supported in a bearing housing 20 or 26, pivotable about an axle 21 or 27 fixedly mounted to the machine (see FIG. 2).

The pair of take-off rolls 4 is arranged behind the second hollow spindle 3; this pair of take-off rolls comprises a drive roll 28 extending over the entire machine and associated with a pressure roll 29 extending over only one spinning station. The pressure roll 29 contacts the drive roll 28 in the operating condition and can be swung away via a lever 30 from the drive roll 28 in the clockwise direction about an axle 31 affixed to the machine. The lever 30 is here fashioned as a double lever which has a concomitantly pivotable extension 32 behind the axle 31.

The windup device 5 is arranged after the pair of take-off rolls 4, this windup device containing, inter alia, a grooved roll 33 serving for traversing the thread 47 to be spooled. Each spinning assembly is associated with a single grooved roll 33 driven indirectly by a drive roll 34 extending through the entire machine. The transmission member is a friction pressure roll 35 provided separately for each spinning station, this friction pressure roll contacting, in the operating condition, the continuous drive roll 34 as well as the grooved roll 33. The friction pressure roll 35 is arranged at a two-armed lever 36, 38 pivotable about a fixed axle 37. In the operating condition, the windup bobbin 39 contacts the grooved roll 33 under spring pressure; this windup bobbin can be swung away from the grooved roll 33 for bobbin exchange by means of a lever 40 pivotable about the axle 41, by way of a handle 42.

In the operating condition illustrated by FIG. 1, sliver 43 is fed by the drawing unit 1 to the hollow spindle 2. This sliver 43, insofar as no twist-blocking means is connected after the spindle, travels essentially without rotation through the hollow spindle 2. From the feed bobbin 19, present on the spindle 2, a binding thread 44 is likewise passed through the hollow spindle and winds around the sliver 43 due to the revolution of the spindle body 16, thus constricting the sliver 43 with spiral-shaped windings. This composite 45, consisting of the sliver 43 and the binding thread 44 exits from the hollow spindle 2 and enters the hollow spindle 3. A second binding thread 46 is introduced from the bobbin 25 seated on the spindle 3, this thread being wound around the thread 45—preferably in opposite spirals. The finished ply yarn 47 exiting from the second hollow spindle 3 is then taken off by the pair of take-off rolls 4 and fed to the windup device 5.

A thread monitor 48 is arranged between the drawing unit 1 and the first hollow spindle 2, monitoring the orderly run of the sliver 43. Behind the second hollow spindle 3, a further thread monitor 49 is arranged which monitors the finished ply yarn 47; breakage of even one component is registered due to the drop in tension. In general, it is sufficient if only these two thread monitors 48 and 49 are provided. However, if necessary additional thread monitors can be arranged, for example, between the two subsequently connected hollow spindles 2 and 3. Optical devices 50 and 51 for scanning the degree of fullness of the bobbins 19 and 25, respectively, are associated with the bobbins 19 and 25 for the binding thread seated on the hollow spindles 2 and 3. These devices 50, 51 transmit a light beam which is reflected by the bobbins 19 and 25, respectively, and as soon as the bobbin is spun empty, a thread-break command is transmitted due to the differing reflection characteristic.

Figure 2:
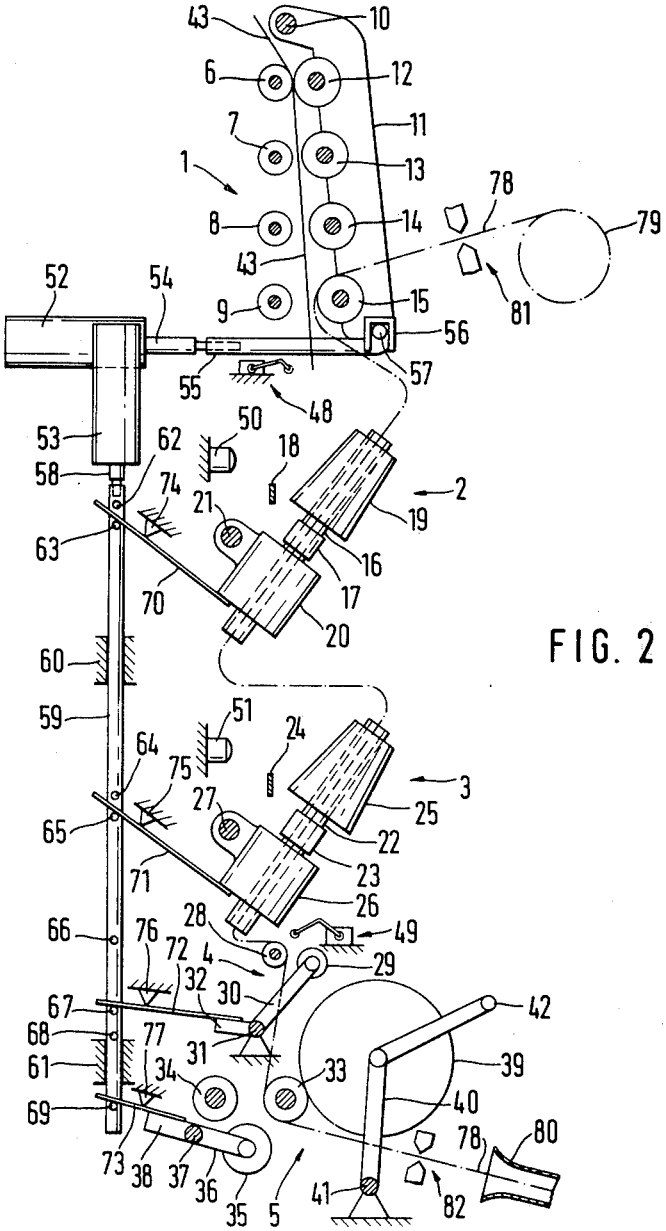
FIG. 2 is a schematic view of the spinning assembly of FIG. 1, but with the drive mechanisms being interrupted.

In case of malfunction, be it after a thread break or after a feed bobbin 19, 25 has become empty, all of the drive mechanisms can be arrested preferably by swinging away the individual elements (see FIG. 2). For this purpose, two pneumatic cylinders 52 and 53 are provided, exhibiting associated operating rods which will at this time be described in conjunction with FIG. 1. The pneumatic conduits of the cylinders 52 and 53, as well as the electric wiring between the thread sensors 48, 49, 50, and 51, as well as the pneumatic cylinders 52 and 53 are not illustrated in the drawing to aid in simplifying this description. Given this description, one skilled in the art can readily ascertain the location of these pneumatic conduits and electrical wiring. The pneumatic cylinder 52 is correlated with the drawing unit 1, whereas the pneumatic dylinder 53 pertains to the hollow spindles 2 and 3, the take-off rolls 4, as well as the windup device 5. The piston 54 of the cylinder 52 is connected to an operating rod 55 to which a guide fork 56 is attached. This guide fork 56 comprises a bolt 57 mounted to the load-bearing member 11. In case of a malfunction, the piston 54 extends out of cylinder 52 and moves the rod 55 toward the right, whereby the load-carrying member 11 and, with the latter, the pressure rolls 12, 13, 14, and 15 are swung away from the driving bottom rolls 6, 7, 8, and 9 (see FIG. 2).

The pneumatic cylinder 53 comprises a piston rod 58 illustrated in the extended position in FIG. 1. The piston rod 58 is connected to an operating rod 59 guided in guide means 60, 61. Guide pins 62, 63, 64, 65, 66, 67, 68, and 69 are mounted to the operating rod 59 and serve, in a manner to be described below, for the guidance of leaf springs 70, 71, 72, and 73. The leaf spring 70 is attached to the bearing box 20 of the hollow spindle 2 and, in the operating condition, contacts the guide pin 62 with a certain pretensioning. In case of a malfunction (see also FIG. 2), the piston 58 is retracted into the cylinder 53, whereby the operating rod 59 is moved upwardly in the FIG. 1 and 2 illustrations. In this case, the guide pin 63 entrains the leaf spring 70 in the upward direction until it abuts a stop 74. In this way, the bearing box 20 is pivoted about the fixed axle 21 and thus the complete spindle 2 with its whorl 17 is swung away from the drive belt 18. For an accelerated shutdown, a brake, not shown, can be additionally provided.

In a similar manner, the leaf spring 71 attached to the bearing box 26 of the spindle 3 contacts under pretensioning the guide pin 64 in the operating condition, and is moved in case of malfunction by the guide pin 65 upwardly against the stop 75, whereby the spindle 3 is pivoted about the axle 27 in the clockwise direction. A leaf spring 72 is mounted to the arm 32 of the two-armed lever 30, 32 and contacts, in the operating condition, the guide pin 66 with slight pretensioning. Due to this pretensioning, the pressure roll 29 is urged against the drive roll 28, whereby the delivery of the ply yarn 47 is effected. In case of a malfunction, the guide pin 67 contacts the leaf spring 72 from below and urges same against a stop 76, whereby the lever 30 is pivoted in the clockwise direction and lifts the pressure roll 29 off the drive roll 28.

The reason for the fact that the spacing between the guide pins 66 and 67 is larger than the spacing between the guide pins 64, 65 is that the leaf spring 72 during swinging away traverses a shorter path than the leaf spring 71. Finally, a leaf spring 73 is attached to the two-armed lever 36, 38 which, in the operating condition, contacts the guide pin 68 under pretensioning and thus urges the friction pressure wheel 35 against the drive roll 34 and the grooved roll 33, whereby the windup bobbin 39 is driven. In case of malfunction the guide pin 69 (see FIG. 2) urges the leaf spring 73 against the stop 77 and thus lifts the friction pressure roll 35 off the grooved roll 33. Thereby the windup bobbin 39 is arrested. All subunits of the spinning device can thus be arrested by mechanical actuation of the operating rods 55 and 59, whenever necessary. Other preferred embodiments are contemplated with the two operating rods 55 and 59 mechanically coupled via a gear system so that only one actuating cylinder is required.

FIG. 2 shows the ply yarn spinning assembly in the shutdown condition, wherein here again the auxiliary thread 78 shown in dot-dash lines is to be ignored initially. To be able to effect piecing at the spinning station, considering that the sliver 43 does not as yet exhibit sufficient strength, an auxiliary thread 78 of increased strength is introduced into the individual elements in some way, be it automatically or manually (see dot-dash illustration of the auxiliary thread 78). This auxilliary thread is arranged on an auxiliary bobbin 79 which can either be correlated with each spinning station or is brought to the troubled spinning station in case of need. The auxiliary thread 78 coming from the auxiliary bobbin 79 is first placed around the top roll 15 of the drawing unit 1 and then introduced in succession through the hollow spindles 2 and 3, furthermore laid around the driven take-off roll 28 as well as around the grooved roll 33, and extended to a suction removal means 80 where it is maintained under a certain tension.

If now the spinning station is returned into its position according to FIG. 1, for example by synchronous operation of the pneumatic cylinders 52 and 53, the auxiliary thread 78 assumes the position illustrated in dot-dash lines in FIG. 1, i.e. it extends from the auxiliary bobbin 79 up to the suction removal means 80. This auxiliary thread 78 entrains the sliver 43, if the thread is wrapped several times around the sliver, as well as the binding threads 44 and 46, and passes together with these into the suction removal means 80. Once the individual elements have reached their normal operating speed, the auxiliary thread 78 is first severed by a cutter 81 in the zone of the bobbin 79. As soon as the cutting site of the auxiliary thread 78 has traveled into the suction removal means 80, the now proper ply yarn 47 is severed by a cutting device 82 in the zone of the suction removal means 80 and inserted into the nip between the grooved roll 33 and the windup bobbin 39 and wound around the latter (see motion arrow for bobbin 39). Thus the piecing step is completed and it is ensured that only proper ply yarn 47 passes onto the windup bobbin 39.

The losses of material due to the suction removal means 80 are minimal as compared with the losses incurred by the previously contemplated arrangements discussed in the introduction, because in the apparatus of this invention the losses take place, rather than uncontrollably, only during the actual piecing step, i.e. during a very short time period, in the presence of an operator.

Figure 3:
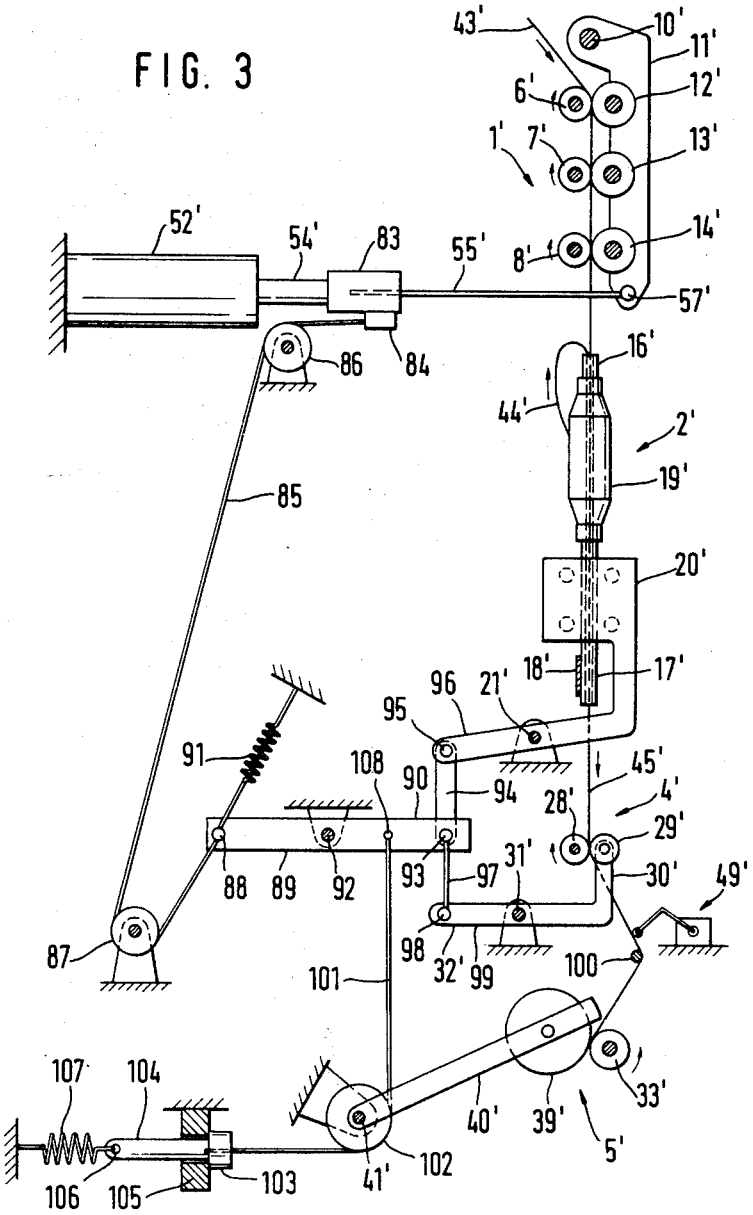
FIG. 3 is a schematic view which shows another embodiment of a ply yarn spinning assembly constructed according to this invention with a preferably pneumatic drive cylinder which ensures the operating position.
Figure 4:
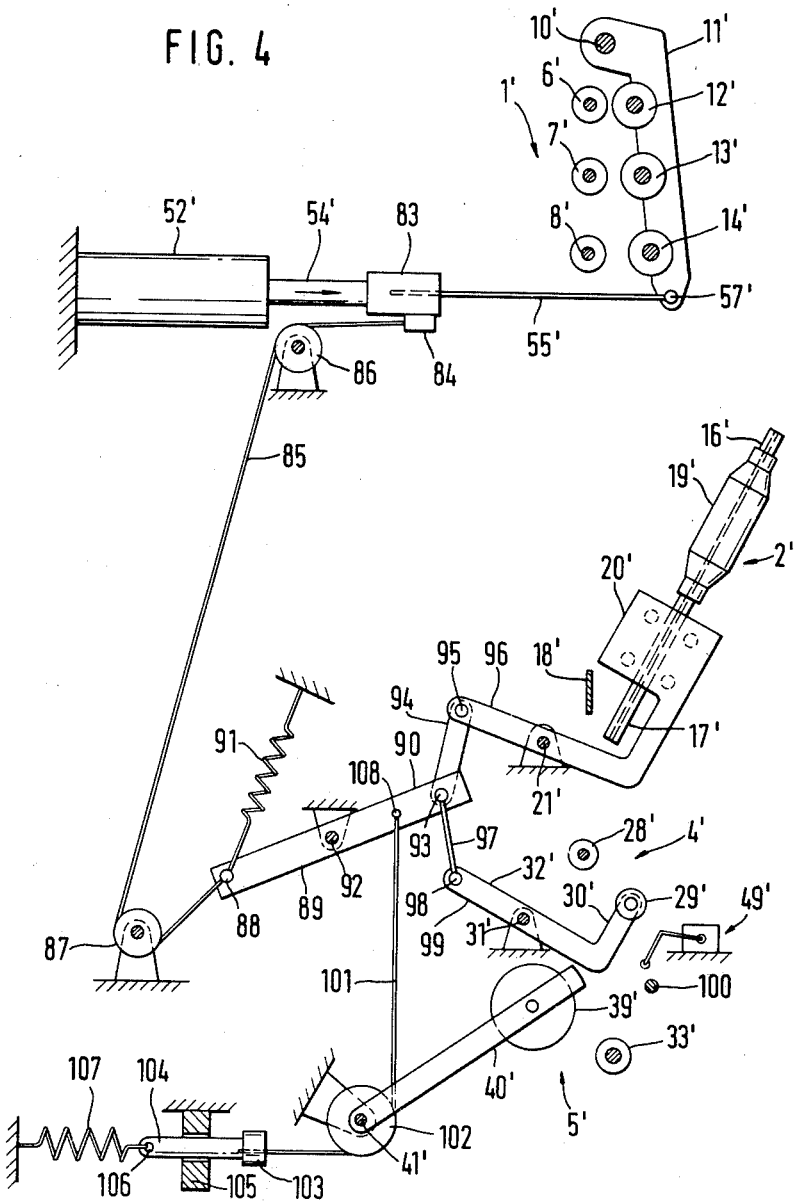
FIG. 4 is a schematic view of the ply yarn spinning assembly of FIG. 3 in the inoperative position with the drive mechanisms interrupted.

In the embodiment of FIGS. 3 and 4, the mechanical operating means is equipped with a single, preferably pneumatic drive cylinder 52'. The drive cylinder 52' is exposed to the pressure medium in a manner not illustrated in detail via a valve preferably fashioned as a solenoid valve, in correspondence with the respectively desired direction of movement. The valve is controlled electrically via a thread monitor 49' arranged in the yarn travel direction between the pair of take-off rolls 28', 29' and a deflection guide means 100, followed by the windup roll 33' for the bobbin 39', constructed as a continuous, stationary cylinder.

The drawing unit 1' is generally similar to the drawing unit 1 of the FIG. 1 embodiment, primsed reference characters indicating correspondingly numbered structures.

The cylinder 52' is rigidly mounted to the machine frame in a manner not illustrated in detail. The piston 54' of the drive cylinder 52' is equipped with a tensioning member 83 into which is clamped a leaf spring 55' oriented in the extension of piston 54'. The free end of this leaf spring is articulated to the free end of the load-bearing member 11' of the drawing unit 1' at a hinge point 57'. The leaf spring 55', held laterally beside the pressure roll 14' at the articulating point 57', is made of sufficient rigidity to be able to transmit the force, required for lifting off the load-bearing member 11', in its longitudinal direction. Transversely thereto, the leaf spring 55' is of such flexibility that it can compensate for the difference between the linear motion of the piston 54' and the circular-arc motion of the point of articulation 57'.

A mounting element 84 for a drawstring 85 is attached to the piston 54' and/or to the tensioning member 83. The drawstring 85 runs over a first, stationary guide roller 86 arranged in the zone of the drive cylinder 52' in the downward direction and then over another, fixedly arranged guide roller 87 back into the upward direction. The drawstring 85 is then articulated to a hinge point 88 of a two-armed intermediate lever 89, 90, the latter being pivotable about a stationary axle 92. A spring 91 tensioning the drawstring 85 engages at the intermediate lever 89; this spring 91 is fashioned as a tension spring and engages at the articulating point 88. The expression "drawstring" is also to encompass a tension cable or the like.

A guide arm 94 engages in an articulating point 93 at the second arm 90 of the intermediate lever 89, 90, this guide arm being connected with an articulating point 95 to a further two-armed lever 96 which is supported to be pivotable about an axle 21 in parallel to the axle 92. This likewise two-armed lever 96 carries with its opposite lever the bearing box 20' of the spindle 2'.

On the side oppositely to the guide arm 94, another guide arm 97 is arranged at the same articulating point 93 of the intermediate lever 89, 90; this other guide arm 97 is constructed, preferably, as a leaf spring and is articulated at a mounting point 98 to an arm 32' of a lever 99, which latter is pivotable about an axle in parallel to the axles 21' and 92' and which carries with its other arm 30 the non-driven take-off roll 29'. The two levers 96 and 99 are thus articulated to the intermediate lever 89, 90 in such a way that they move in the same sense in case of an adjustment of the intermediate lever 89, 90.

Another tension cable 101 (drawstring) is articulated to the arm 90 of the lever 89, 90 and is stressed by a tension spring 107 engaging at the machine frame. The tension cable 101 is placed around a disk 102 nonrotationally connected with the bobbin creel 40' of the bobbin 39' and arranged coaxially to its pivot axle 41'. Between the tension spring 107 and the tension cable 101, a bolt 104 is provided which is guided in a sliding guide means 105. The end of this bolt is provided with an eye 106 for hanging of the tension spring 107. The bolt 104 is formed, on the side of the sliding guide means 105 facing away from the tension spring 107, with a thickened head or annular collar 103 limiting the movement of the bolt 104 and thus also of the tension cable 101. The position of the sliding guide means 105 and of the head 103 is selected so that, in the operating condition (FIG. 3), the head 103 contacts the sliding guide means 105 in such a way that the tension cable 101 is placed only loosely around the disk 102 so that no force is transmitted to the disk 102 by the tension cable 101. The bobbin creel 40', stressed as usual by a load spring, not shown, in the direction toward the windup roll 33', is thus freely movable in the operating position so that it can adapt its position to the respective diameter of the bobbin 39'.

To arrest the spinning assembly, the piston 54' of the operating cylinder 52' is extended by being correspondingly exposed to pressure medium (FIG. 4), so that, via the lead spring 55', the piston lifts the load-bearing member 11' off the bottom rolls 6', 7', and 8' fashioned as continuous cylinders. At the same time, the piston 54' pivots the lever 96 via the tension cable 85 and the lever mechanism, so that the spindle 2' is lifted off the tangential belt 18'. Furthermore, the lever 99 is pivoted in such a way that the non-driven take-off roll 29' is lifted off the take-off roll 28' fashioned as a continuous cylinder. Additionally, via the tension cable 101, the bobbin creel 40' is pivoted so that the bobbin 39' is lifted off the windup roll 33'. While the intermediate lever 89 is swung in the direction toward the inoperative position, the tension cable 101 is tensioned by the tensile force of the tension spring 107 and contacts the disk 102 in the tensioned condition. The friction resulting from the looping angle (90° in this embodiment) between the disk 102 and the tension cable 101 provides an entrainment force by which the bobbin creel 40' with the bobbin 39' is pivoted. The pivoting path of the bobbin creel 40' is, in this connection, entirely independent of the respective position of the bobbin creel 40', which latter is dependent on the diameter of the bobbin 39'.

When restoring the operative position, the piston 54 of the drive cylinder 52, starting with the position as shown in FIG. 4, is retracted so that it moves the load-bearing member 11' with the top rolls 12', 13', and 14' resiliently held therein again into association with the bottom rolls 6', 7', and 8'. The operating position of the drawing unit 1' is then secured again by the drive cylinder 52'. The tension spring 91 causes the intermediate lever 89 to resume its operating position (FIG. 3), whereby the spindle 2' is associated with the tangential belt 18' and the non-driven take-off roll 29' is associated with the driven take-off roll 28'; furthermore the bobbin 39' is brought into association with the windup roll 33', this latter step being accomplished by the entrainment force of the tension spring 107, namely to such an extent that the head 103 comes into contact with the guide means 105.

For effecting the piecing operation after an interruption in the work process, it has proven to be advantageous if the activation of the drives for the spindle 2' and the closing of the take-off rolls 28' and 29', as well as the engagement of the bobbin 39' with the windup roll 33' takes place with a time delay as compared with the closing of the drawing unit 1'. For this purpose, an independently controllable, movable stop is suitably provided, which makes it possible to return the spindle 2', the take-off roll 29', and the bobbin creel 40' into the operative position with a time delay. A mechanical locking element is then preferably provided, for example, which is actuated by the operator and which locks the inoperative position of one of the levers 89, 96, or 99 into place at some point. Of course, the invention also contemplates to utilize a pneumatically or electrically controlled locking element in the form an operating magnet or an operating cylinder.

While we have shown and described several embodiments in accordance with the present invention, it is understood that the same is not limited thereto but is susceptible to numerous changes and modifications as known to those skilled in the art and we therefore do not wish to be limited to the details shown and described herein but intend to cover all such changes and modifications as are encompassed by the scope of the appended claims.

We claim:

1. Ply yarn spinning assembly comprising:

a drawing unit for drawing sliver, at least one hollow spindle arranged downstream of the drawing unit, a binding thread bobbin provided respectively at each of said at least one hollow spindles and having a supply of binding thread thereon for binding the sliver passing through the at least one hollow spindle, drawing unit and hollow spindle driving means, thread monitoring means for monitoring the yarn condition at at least one position downstream of the drawing unit, and an operating mechanism for swinging open a load-bearing member of the drawing unit to interrupt the drawing unit driving means in automatic response to detection of a malfunction by said thread monitoring means.

2. An assembly according to claim 1, further comprising:

a pair of take-off rolls and a yarn windup device downstream of said at least one hollow spindle for taking off and winding up the yarn being formed, and driving means for said take-off rolls and yarn windup device, wherein drive interrupting means are provided for automatically interrupting the driving means for the hollow spindle, the take-off rolls, and the yarn winding device in response to detection of a malfunction by said thread monitoring means.

3. An assembly according to claim 2, wherein the operating mechanism is mechanical in nature and that likewise mechanically acting operating means are provided for interrupting the driving means of the at least one hollow spindle, the take-off rolls and the yarn winding device.

4. An assembly according to claim 3, wherein each of the driving means for the drawing unit, the at least one hollow spindle, the take-off rolls, and the yarn winding device are equipped with drivable parts which can be swung away from constantly rotating, driven parts.

5. An assembly according to claim 1, wherein the operating mechanism includes at least one operating rod operable by way of a pressure cylinder or the like.

6. An assembly according to claim 4, wherein the mechanical operating mechanism includes at least one operating rod operable by way of a pressure cylinder or the like.

7. An assembly according to claim 6, wherein the operating rod is associated with guide means for interrupting the drive mechanisms of the hollow spindles of the pair of take-off rolls and of the windup device.

8. An assembly according to claim 7, wherein the guide means are guide pins, each of which guides a lever arm fashioned as a leaf spring, each of such lever arms being attached to a component which can be swung away from the driven parts.

9. An assembly according to claim 8, wherein two series-connected hollow spindles are provided which can be swung away from respective drive belts with their drive whorls.

10. An assembly according to claim 2, wherein the pair of take-off rolls comprises a pressure roll which latter can be swung away from a drive roll.

11. An assembly according to any one of claims 7 or 9, wherein the pair of take-off rolls comprises a pressure roll which latter can be swung away from a drive roll.

12. An assembly according to claim 2, wherein the windup device comprises a drive roll and, at a radial spacing therefrom, a grooved roll, both of which are in engagement with a friction pressure roll transmitting the drive action, this friction pressure roll being pivotable away from the grooved roll.

13. An assembly according to any one of claims 7 or 9, wherein the windup device comprises a drive roll and, at a radial spacing therefrom, a grooved roll, both of which are in engagement with a friction pressure roll transmitting the drive action, this friction pressure roll being pivotable away from the grooved roll.

14. An assembly according to claim 2, wherein the thread monitoring means includes respectively one thread monitor arranged between the drawing unit and the hollow spindle as well as between the hollow spindle and the pair of take-off rolls.

15. An assembly according to any one of claims 3, 4, or 9, wherein the thread monitoring means includes respectively one thread monitor arranged between the drawing unit and the hollow spindle as well as between the hollow spindle and the pair of take-off rolls.

16. An assembly according to claim 14, wherein each hollow spindle is associated with a preferably optical device for scanning the degree of fullness of the bobbin for the binding thread, said optical device forming part of said thread monitoring means.

17. An assembly according to claim 1, further comprising an auxiliary bobbin with an auxiliary thread for restarting purposes.

18. An assembly according to claim 2, further comprising an auxiliary bobbin with an auxiliary thread for restarting purposes.

19. An assembly according to claim 18, wherein the auxiliary thread can be fed to a suction removal means.

20. An assembly according to claim 18 or 19, wherein the auxiliary thread is associated with a cutting means after the auxiliary bobbin as well as before the suction removal means.

21. An assembly according to any one of claims 2, 7, 12 or 16, wherein means are provided for simultaneously starting up the drawing unit, the spindles, the pair of take-off rolls, and the windup device.

22. An assembly according to claim 3, wherein the mechanical operating mechanism contains a preferably pneumatic drive cylinder, the piston of which engages via operating means at the load-bearing member of the drawing unit and is connected via a pulley to a lever mechanism, by way of which the spindle can be disengaged from its drive means, the pair of take-off rolls can be moved apart, and the bobbin can be lifted off the windup roll against the force of one or several springs maintaining the aforementioned parts in the operating position.

23. An assembly according to claim 4, wherein the mechanical operating mechanism contains a preferably pneumatic drive cylinder, the piston of which engages via operating means at the load-bearing member of the drawing unit and is connected via a pulley to a lever mechanism, by way of which the spindle can be disengaged from its drive means, the pair of take-off rolls can be moved apart, and the bobbin can be lifted off the windup roll, against the force of one or several springs maintaining the aforementioned parts in the operating position.

24. An assembly according to claim 22, wherein the pulley is articulated to one arm of a two-armed intermediate lever, a spring engaging at this one arm and acting against the pulling direction of the pulley, the other arm of this lever being connected via a guide arm with a lever retaining the spindle bearing and via a second guide arm with a lever retaining the non-driven take-off roll.

25. An assembly according to claim 22, wherein the lever mechanism is connected via a disk and tension cable mechanism with a pivoting drive means for a take-up bobbin creel, which, in the operating position of the drive mechanisms, does not impede the mobility of the take-up bobbin creel.

26. An assembly according to claim 24, wherein the lever mechanism is connected via a disk and tension cable mechanism with a pivoting drive means for a take-up bobbin creel, which, in the operating position of the drive mechanisms, does not impede the mobility of the take-up bobbin creel.

27. An assembly according to claim 25, wherein the tension cable is tensioned by a tension spring and is articulated to the intermediate lever, this tension cable being placed over the disk which is nonrotationally connected to the pivotable take-up bobbin creel, the displacement of this tension cable being limited in the operative direction of the tension spring by a stop means, this stop means being arranged so that the tension cable, in the operating position, extends without tension over the disk.

28. An assembly according to any one of claims 22, 24 or 27, wherein the lever mechanism is provided with a control stop which blocks the return into the operative position and can be activated independently of the drive cylinder.

29. An assembly according to any one of claims 22, 24, 27 or 28, wherein the piston of the drive cylinder is connected, via a leaf spring arranged in its extension, with the free end of the load-bearing member of the drawing unit.

* * * * *